US009633600B2

(12) United States Patent
Araki

(10) Patent No.: US 9,633,600 B2
(45) Date of Patent: Apr. 25, 2017

(54) DISPLAY DEVICE AND ELECTRONIC APPLIANCE

(71) Applicant: Sony Corporation, Tokyo (JP)

(72) Inventor: Shoji Araki, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 14/565,519

(22) Filed: Dec. 10, 2014

(65) Prior Publication Data

US 2015/0213758 A1 Jul. 30, 2015

(30) Foreign Application Priority Data

Jan. 24, 2014 (JP) ..... 2014-011557

(51) Int. Cl.

*G09G 3/30* (2006.01)
*G09G 3/3233* (2016.01)
*G09G 3/3258* (2016.01)

(52) U.S. Cl.

CPC ..... *G09G 3/3233* (2013.01); *G09G 3/3258* (2013.01); *G09G 2230/00* (2013.01); *G09G 2300/0819* (2013.01); *G09G 2300/0852* (2013.01); *G09G 2320/0223* (2013.01); *G09G 2320/0233* (2013.01)

(58) Field of Classification Search

CPC .. G09G 3/30; G09G 3/20; G09G 3/36; G09G 3/28; G09G 3/18; G09G 5/10; H05B 33/14; G06K 9/00

See application file for complete search history.

(56) References Cited

U.S. PATENT DOCUMENTS

2010/0156860 A1* 6/2010 Yamamoto ..... G09G 3/3233 345/205
2011/0050666 A1* 3/2011 Inoue ..... G09G 3/2014 345/211
2011/0109610 A1* 5/2011 Yamamoto ..... G09G 3/325 345/211
2012/0146886 A1* 6/2012 Minami ..... H01L 27/3276 345/80
2012/0249515 A1* 10/2012 Omoto ..... H01L 27/3272 345/212

FOREIGN PATENT DOCUMENTS

JP 2004-133240 A 4/2004

* cited by examiner

*Primary Examiner* — Pegeman Karimi
(74) *Attorney, Agent, or Firm* — Michael Best & Friedrich LLP

(57) ABSTRACT

There is provided a display device including a light-emitting portion configured to constitute a pixel and emit light by a drive current, a writing transistor configured to write a video signal into pixel capacitance, a driving transistor configured to control the drive current of the light-emitting portion on the basis of the video signal written in the pixel capacitance, a first metal layer configured to constitute a drain and a source of each of the driving transistor and the writing transistor, and a second metal layer configured to constitute a gate of each of the driving transistor and the writing transistor.

20 Claims, 10 Drawing Sheets

DISPLAY DEVICE AND ELECTRONIC APPLIANCE

CROSS REFERENCE TO RELATED APPLICATIONS

This application claims the benefit of Japanese Priority Patent Application JP 2014-011557 filed Jan. 24, 2014, the entire contents of which are incorporated herein by reference.

BACKGROUND

The present disclosure relates to a display device and an electronic appliance. Specifically, it relates to a display device and an electronic appliance that can suppress deterioration in performance due to in-plane unevenness caused by mask displacement in a display panel including an organic EL element.

In recent years, development of a display device including a flat self-luminous panel (EL panel) using an organic electro luminescent (EL) element as a light-emitting element has been becoming active. The organic EL element is a device utilizing a phenomenon in which, when an electric field is applied to an organic thin film, the organic thin film emits light. Since the organic EL element is driven at an applied voltage of 10 V or less, the organic EL element has low power consumption. Further, since the organic EL element is a self-luminous element that emits light by itself, the organic EL element facilitates reductions in its weight and thickness without involving a lighting member. Moreover, since the organic EL element has a very high response speed in the order of several μs, an afterimage during display of a moving picture is not generated.

There is proposed a display device utilizing such an organic EL element (see JP 2004-133240A).

SUMMARY

Meanwhile, in the display device utilizing the organic EL element, electrostatic capacitance parasitic to a thin film transistor (TFT) included in a pixel circuit may bring about various side effects on an ideal drive.

For example, the electrostatic capacitance parasitic to the TFT may appear as variations within a display surface due to such as displacement of a mask formed of a metal substrate that is stacked in a manufacturing process, causing a change in electric potential at the rising or falling of a drive waveform to thereby affect a drive condition, resulting in unevenness in a visible state.

Consequently, in such a case where a large-sized display is configured, when the display device utilizing the organic EL element is enlarged, there may be a possibility that the unevenness becomes further conspicuous.

The present disclosure has been developed in view of such a situation. Specifically, it may suppress an effect on the drive waveform even when the mask displacement occurs, thereby suppressing the occurrence of the unevenness.

According to an embodiment of the present disclosure, there is provided a display device including a light-emitting portion configured to constitute a pixel and emit light by a drive current, a writing transistor configured to write a video signal into pixel capacitance, a driving transistor configured to control the drive current of the light-emitting portion on the basis of the video signal written in the pixel capacitance, a first metal layer configured to constitute a drain and a source of each of the driving transistor and the writing transistor, and a second metal layer configured to constitute a gate of each of the driving transistor and the writing transistor. The drain and the source of each of the driving transistor and the writing transistor in the first metal layer are opposed to each other in a same predetermined direction, and the drain and the source of each of the driving transistor and the writing transistor are opposed to each other in reverse directions to each other in the same predetermined direction.

Both of the driving transistor and the writing transistor may be a P channel or an N channel.

The source of each of the driving transistor and the writing transistor may be connected to the pixel capacitance.

Electric potential of the drain of the driving transistor may be set to intermediate electric potential at timing immediately before the writing transistor writes the video signal into the pixel capacitance. Next, electric potential of the gate of the writing transistor may be set to a high level, and may then be set to a low level after the writing transistor writes the video signal into the pixel capacitance. Then, the electric potential of the drain of the driving transistor may be set to a high level.

Parasitic capacitance between the gate and the drain of the driving transistor and parasitic capacitance between the gate and the source of the writing transistor in the first metal layer may be adjusted so that a first rush-in voltage of when the electric potential of the gate of the writing transistor is set to the low level after the writing transistor writes the video signal into the pixel capacitance, and a second rush-in voltage of when the electric potential of the drain of the driving transistor is set to the high level after the writing transistor writes the video signal into the pixel capacitance are cancelled by each other.

The display device may further include dummy capacitance configured to adjust a balance between the parasitic capacitance of the driving transistor and the parasitic capacitance of the writing transistor.

According to another embodiment of the present disclosure, there is provided an electronic appliance including a light-emitting portion configured to constitute a pixel and emit light by a drive current, a writing transistor configured to write a video signal into pixel capacitance, a driving transistor configured to control the drive current of the light-emitting portion on the basis of the video signal written in the pixel capacitance, a first metal layer configured to constitute a drain and a source of each of the driving transistor and the writing transistor, and a second metal layer configured to constitute a gate of each of the driving transistor and the writing transistor. The drain and the source of each of the driving transistor and the writing transistor in the first metal layer are opposed to each other in a same predetermined direction, and the drain and the source of each of the driving transistor and the writing transistor are opposed to each other in reverse directions to each other in the same predetermined direction.

According to an embodiment of the present disclosure, a light-emitting portion configured to constitute a pixel emits light by a drive current, a writing transistor writes a video signal into pixel capacitance, a driving transistor controls the drive current of the light-emitting portion on the basis of the video signal written in the pixel capacitance, a first metal layer constitutes a drain and a source of each of the driving transistor and the writing transistor, a second metal layer constitutes a gate of each of the driving transistor and the writing transistor, the drain and the source of each of the driving transistor and the writing transistor in the first metal layer are opposed to each other in the same predetermined direction, and the drain and the source of each of the driving transistor and the writing transistor are opposed to each other in reverse directions to each other in the same predetermined direction.

According to an embodiment of the present disclosure, it may be possible to suppress the occurrence of the unevenness in the display device utilizing the organic EL element.

DETAILED DESCRIPTION OF THE EMBODIMENT(S)

<Circuit Configuration Example of Display Device>

Figure 1:
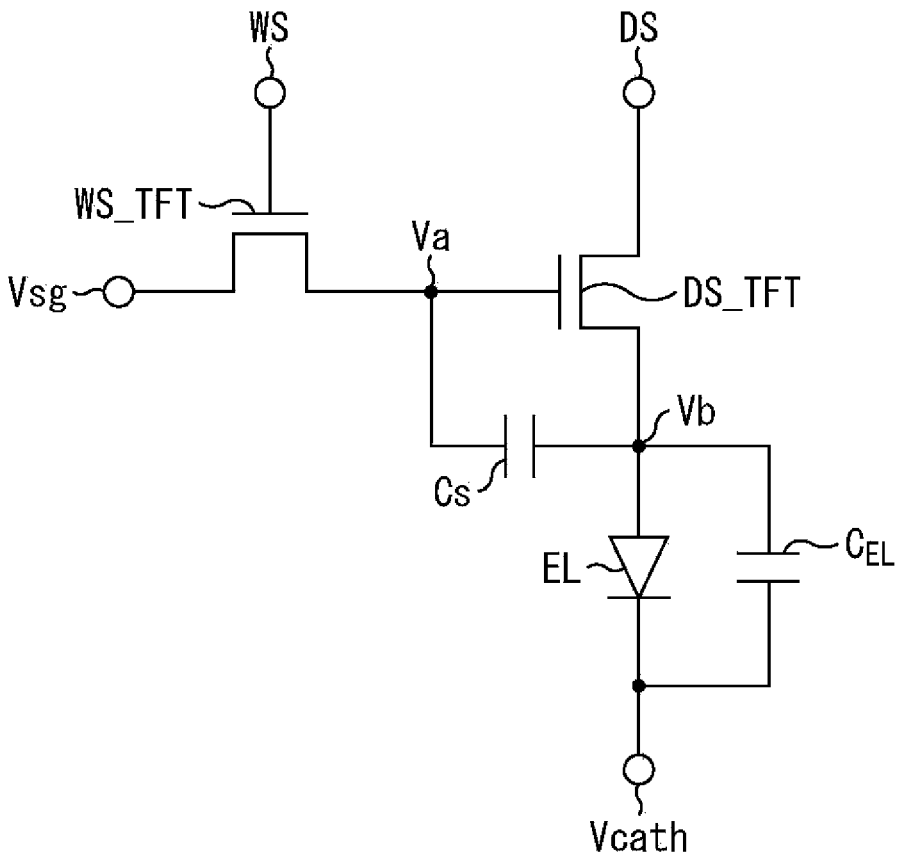
FIG. 1 is a diagram for explaining the configuration of a pixel circuit of a display device according to an embodiment of the present disclosure.

FIG. 1 is a circuit diagram illustrating a configuration example of a display device according to an embodiment of the present disclosure.

The circuit diagram of FIG. 1 illustrates a circuit constituting one pixel of the display device including a flat self-luminous panel (EL panel) utilizing an organic electro luminescent (EL) element.

The pixel circuit includes a writing transistor WS_TFT, a driving transistor DS_TFT, pixel capacitance Cs, and an organic EL element EL. Both of the writing transistor WS_TFT and the driving transistor DS_TFT include a thin film transistor. Note that capacitance CEL in the figure is parasitic capacitance of the organic EL element, generated by constituting the circuit, and an entity as a circuit does not exist.

The writing transistor WS_TFT has a gate connected to writing wiring WS and receives input of a video signal supplied to a drain from a signal output portion (not shown). Also, a source of the writing transistor WS_TFT is connected to one end of the pixel capacitance Cs and a gate of the driving transistor DS_TFT. A drain of the driving transistor DS_TFT is connected to driving wiring DS, and the drain is connected to the other end of the pixel capacitance Cs and an anode of the organic EL element EL. A cathode of the organic EL element is connected to predetermined electric potential Vcath. The parasitic capacitance CEL exists in parallel connection with the organic EL element EL.

<Typical Operation>

Figure 2:
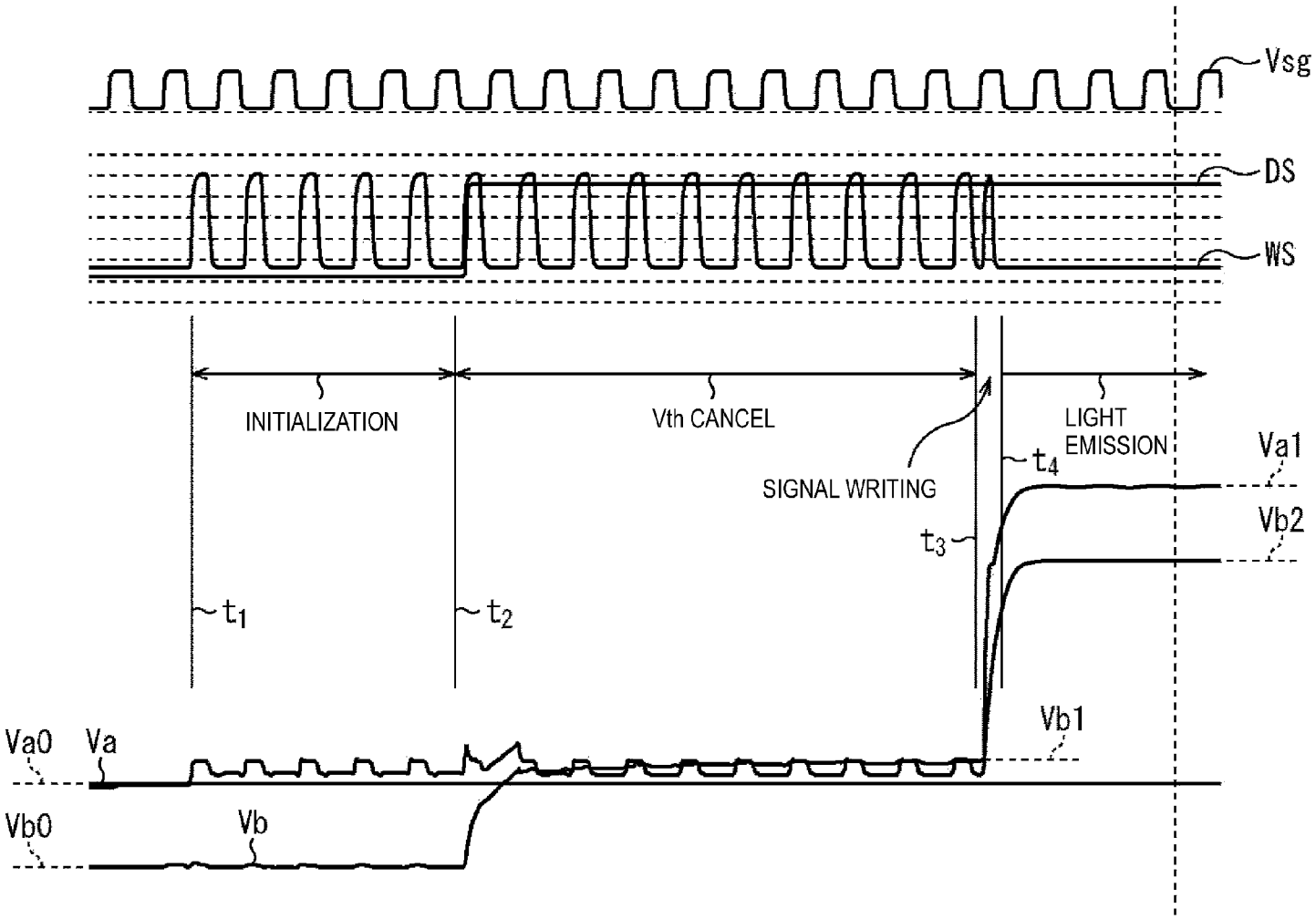
FIG. 2 is a timing chart for explaining a typical control method for the pixel circuit of FIG. 1.

Next, with reference to the waveform diagram of FIG. 2, a typical operation will be described. Note that FIG. 2 is the waveform diagram illustrating a time-series change of each of a video signal Vsg, a writing signal WS via the writing wiring, a drive signal DS via the driving wiring, a gate voltage Va of the driving transistor DS_TFT in FIG. 1, and an anode voltage Vb of the organic EL element EL in FIG. 1.

From a time t1 to a time t2, while the drive signal DS is at a low level and output of the writing signal WS is started, initialization processing of the circuit is executed.

From a time t2 to a time t3, the drive signal DS is controlled to a high level, and threshold Vth cancel processing of correcting variations in a threshold Vth of the driving transistor DS_TFT is executed, and a voltage corresponding to the threshold Vth is then written into the pixel capacitance Cs. At this time, the anode voltage Vb of the organic EL element EL is increased from electric potential Vb0 to electric potential Vb1 with an increase in the drive signal DS.

From a time t3 to a time t4, the writing transistor WS_TFT is turned on, and a voltage corresponding to the video signal is written into the pixel capacitance Cs so as to be added to the voltage corresponding to the threshold Vth, and the writing signal WS is controlled to a low level. At this time, the gate voltage Va of the driving transistor DS_TFT and the anode voltage Vb of the organic EL element EL are increased from electric potential Va0 to electric potential Va1 and from the electric potential Vb1 to electric potential Vb2, respectively.

Then, at a time t4 or later, a current corresponding to gate-source electric potential of the driving transistor DS_TFT flows between the drain and the source, and flows from the anode to the cathode of the organic EL element EL, thereby allowing the organic EL element EL to emit light.

<Voltage Drop after Writing>

Figure 3:
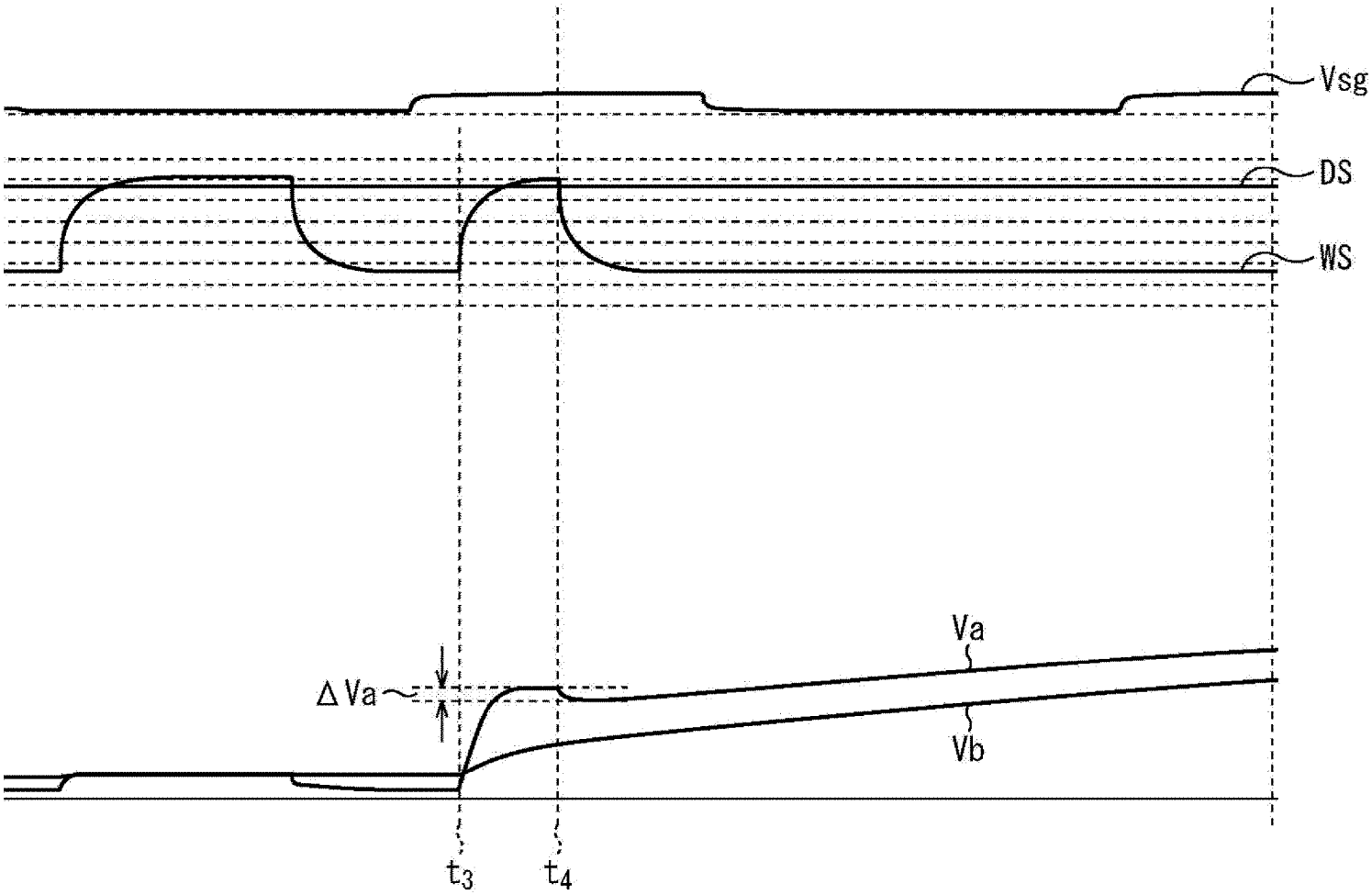
FIG. 3 is a timing chart illustrating an enlarged one portion of FIG. 2.

Meanwhile, immediately after the light emission is started after the voltage corresponding to the video signal is written into the pixel capacitance Cs, that is, immediately after the time t4, as shown in FIG. 3, the voltage Va drops. Here, FIG. 3 is a diagram illustrating an enlarged portion around from the time t3 to the time t4.

That is, as shown in the timing immediately after the time t4 in FIG. 3, the gate voltage Va of the drive transistor DS_TFT drops by ΔVa.

<Reason for Voltage Drop>

The voltage drop is caused by parasitic capacitance of the circuit.

Figure 4:
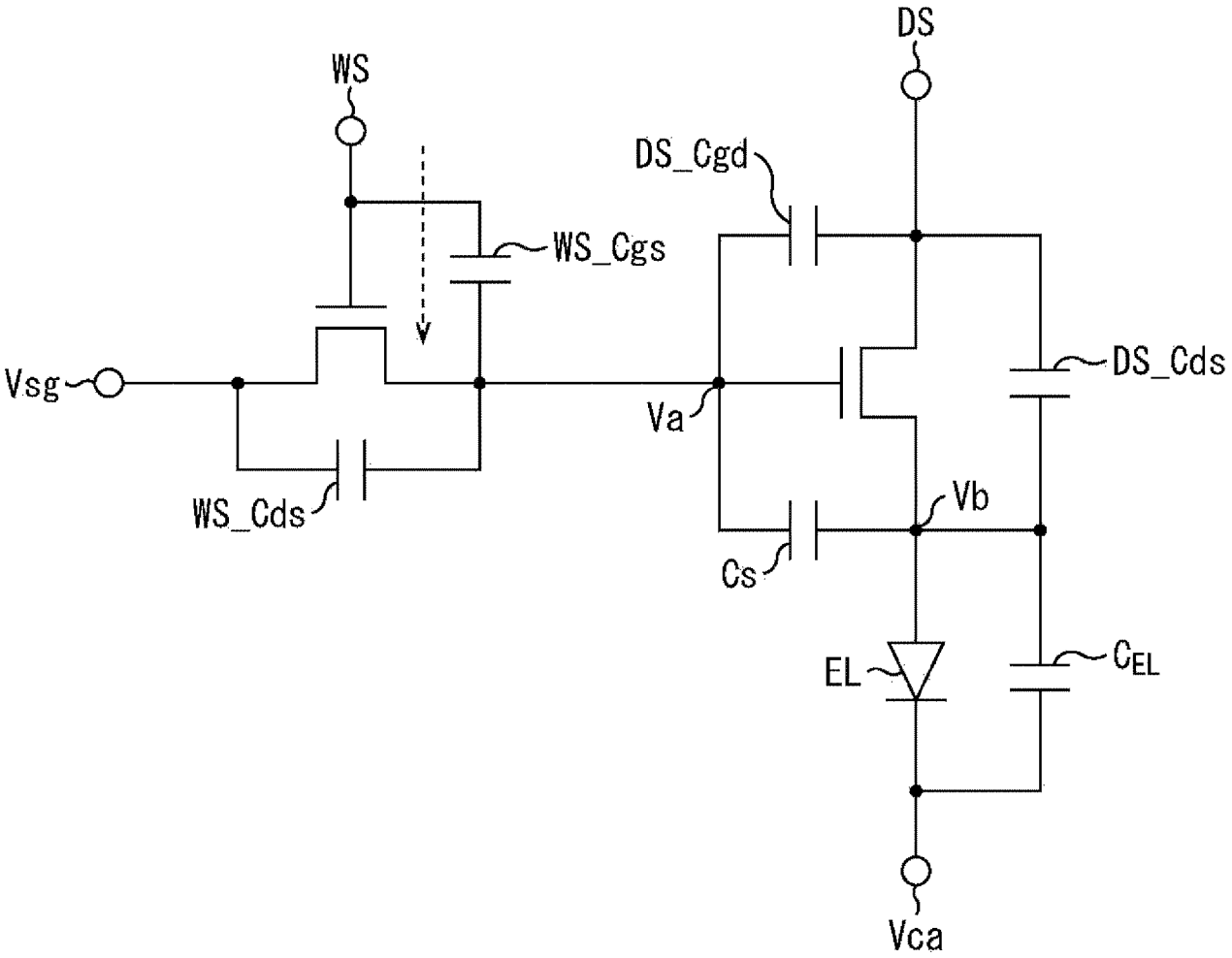
FIG. 4 is a circuit diagram in which parasitic capacitance is added to the pixel circuit of FIG. 1.

Here, for seeking the reason for the voltage drop, as shown in FIG. 4, the circuit containing parasitic capacitance of the writing transistor WS_TFT and the driving transistor DS_TFT will be discussed.

That is, in FIG. 4, parasitic capacitance WS_Cgs between the gate and the source of the writing transistor WS_TFT, parasitic capacitance WS_Cds between the drain and the source of the writing transistor WS_TFT, parasitic capacitance DS_Cgd between the gate and the drain of the driving transistor DS_TFT, and parasitic capacitance DS_Cds between the drain and the source of the driving transistor DS_TFT are added to the pixel circuit that exists as an entity.

In consideration of the parasitic capacitance as shown in FIG. 4, an operation in writing will be discussed as follows.

That is, when the wiring signal WS in FIG. 4 falls, the gate voltage Va of the driving transistor DS_TFT is pulled down via the parasitic capacitance WS_Cgs shown by the dotted arrow in the figure.

Further, when the wiring signal WS in FIG. 4 falls, the anode voltage Vb of the organic EL element EL is also pulled down via the parasitic capacitance WS_Cgs shown by the dotted arrow in the figure, and the pixel capacitance Cs. However, because the parasitic capacitance CEL is sufficiently greater than the pixel capacitance Cs, the effect is limited to be small.

Consequently, a gate-source voltage Vgs of the driving transistor DS_TFT drops immediately before the organic EL element EL emits light.

Within the display panel, a mask pattern constituting a first metal layer constituting the drain and the source and a mask pattern constituting a second metal layer constituting the gate are laminated. Mask displacement, displacement of these masks, may lead to variations in the parasitic capacitance WS_Cgs. The variations may change a current flowing into the organic EL element EL to cause visible unevenness.

<Detailed Reason for Unevenness>

Here, the detailed reason for the unevenness will be discussed.

At timing immediately after the time t4 in FIG. 3, when the video signal is written, the writing signal WS is turned off to bring a position of the gate of the driving transistor DS_TFT on the circuit into a high impedance state. An operation at this time may have a significant impact on the phenomenon of the unevenness.

Figure 5:
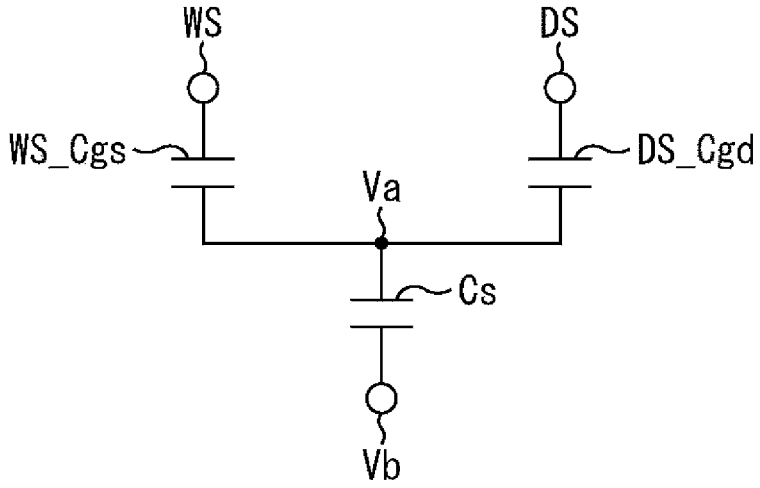
FIG. 5 is an equivalent circuit after writing processing is executed.

An equivalent circuit at this time is the circuit as shown in FIG. 5.

That is, the parasitic capacitance WS_Cgs and DS_Cgd, and the pixel capacitance Cs are each connected to a position Va as the gate voltage Va of the driving transistor DS_TFT.

Therefore, when the amount of voltage drop of the writing signal WS shown in FIG. 3 is electric potential (−Vws), a rush-in voltage ΔVa generated by the falling of the writing signal WS is {−Vws×WS_Cgs/(WS_Cgs+Cs+WS_Cgd)}.

Here, typically, since the pixel capacitance Cs is sufficiently greater than the parasitic capacitance WS_Cgs (Cs>>WS_Cgs), when the parasitic capacitance WS_Cgs varies by 10% due to the mask displacement described above, the rush-in voltage ΔVa also varies by 10%, and the writing signal WS is constant regardless of the video signal Vsg. Accordingly, when the video signal Vsg is low in low-intensity light emission, variations in the gate-source voltage Vgs of the driving transistor DS_TFT may be measurable.

<Control Method for Pixel Circuit According to Embodiment of Present Disclosure>

Now, in an embodiment of the present disclosure, the occurrence of the unevenness described above may be suppressed by a control method that responds to the variations due to the mask displacement, and a wiring configuration of the pixel circuit.

First, with reference to FIG. 6 and FIG. 7, there will be discussed the control method for the pixel circuit according to an embodiment of the present disclosure.

Figure 6:
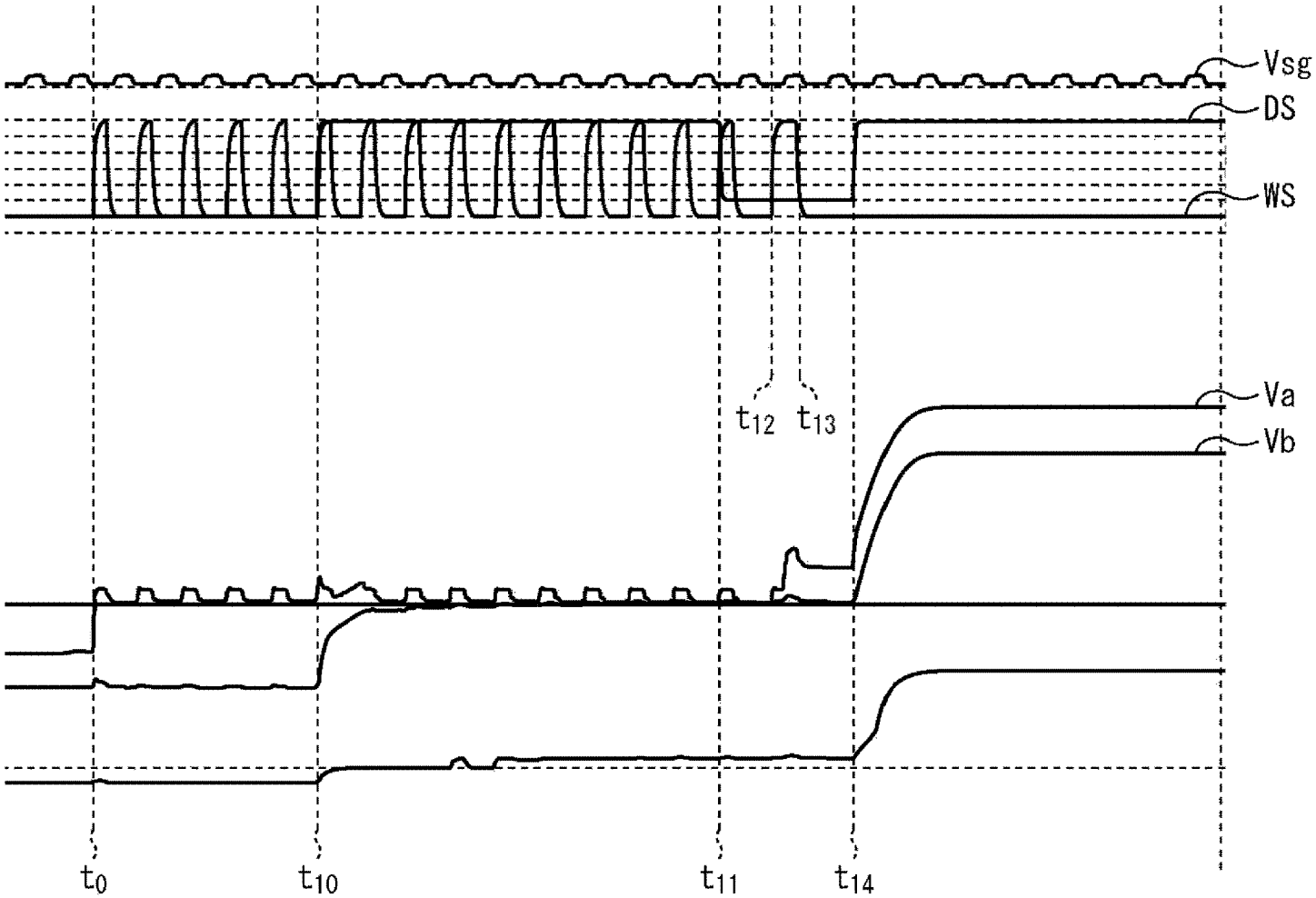
FIG. 6 is a timing chart for explaining a control method for the pixel circuit of FIG. 1, according to an embodiment of the present disclosure.
Figure 7:
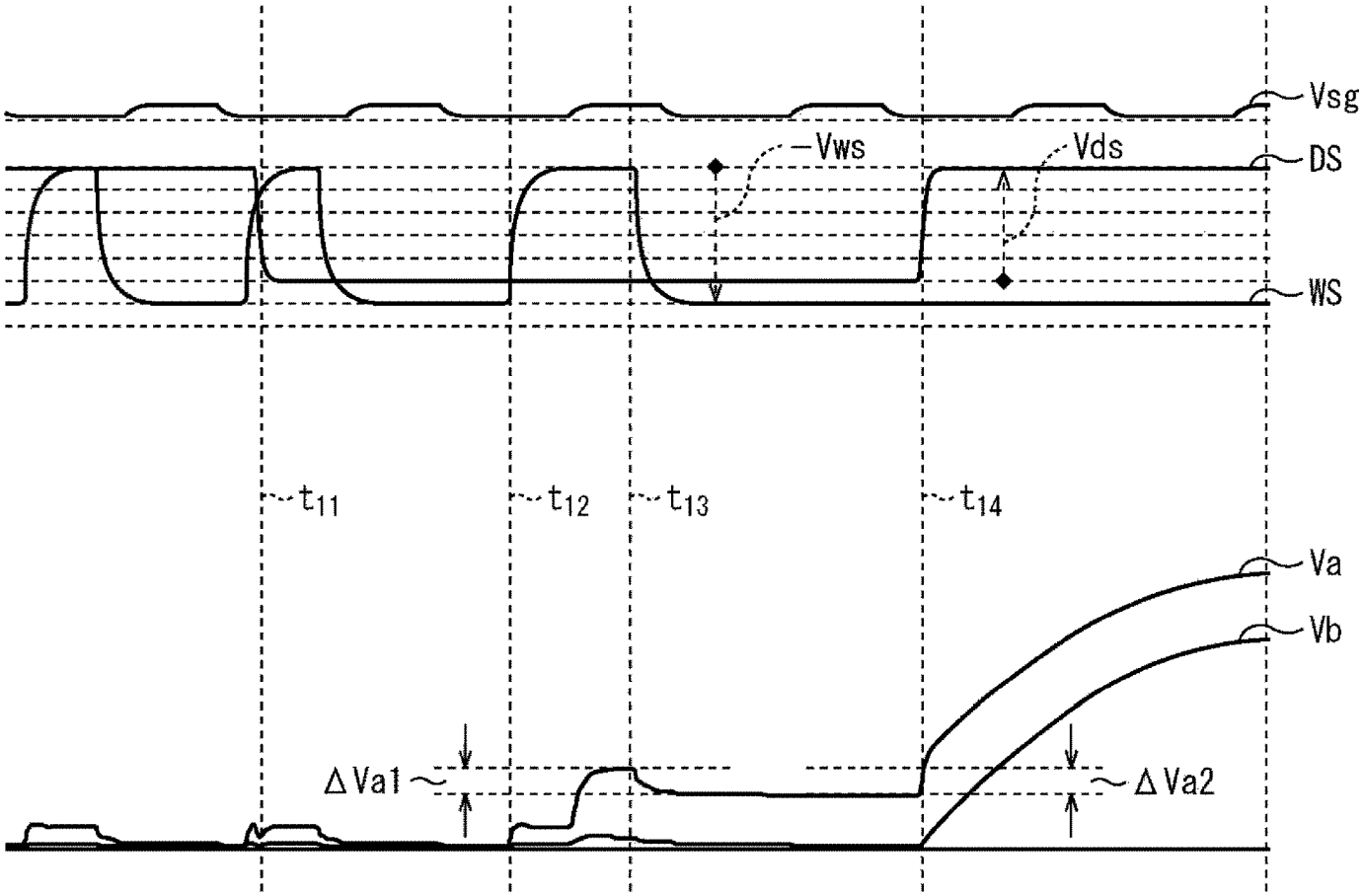
FIG. 7 is a timing chart illustrating an enlarged one portion of FIG. 6.

FIG. 6 and FIG. 7 are waveform diagrams basically similar to the waveform diagrams described above in FIG. 2 and FIG. 3. Since the processing from a time t0 to a time t11 according to an embodiment of the present disclosure is also similar to the processing from the time t1 to the time t3 described above, the description is omitted.

At the time t11, a voltage of the driving signal DS is switched to intermediate electric potential between a high level and a low level. At this time, since the gate voltage Va of the driving transistor DS_TFT enters a low impedance state, a rush-in voltage via the parasitic capacitance DS_Cgs is generated due to a falling electric potential difference (−Vds) of the driving signal DS, but the rush-in voltage is believed to be minute.

From a time t12 to a time t13, the writing transistor WS_TFT is turned on, and a voltage corresponding to the video signal is written into the pixel capacitance Cs so as to be added to a voltage corresponding to the threshold Vth, and the writing signal WS is controlled to a low level.

Then, immediately after a time t13, as described above, the gate voltage Va of the driving transistor DS_TFT falls by a rush-in voltage (ΔVa1) caused by the parasitic capacitance WS_Cgs due to a falling electric potential difference (−Vws) of the writing signal WS. Moreover, at this timing or later, the driving transistor DS_TFT is turned on, but the intermediate electric potential of the voltage of the driving signal DS may prevent a current from flowing in the organic EL element EL to prevent light emission.

At a time t14, when the driving signal DS is switched to a high level, a current flows in the organic EL element EL to start light emission. At this time, the gate voltage Va of the driving transistor DS_TFT rises via the parasitic capacitance DS_Cgd by a rush-in voltage (ΔVa2) due to a rising electric potential difference (Vds).

Therefore, the circuit is configured so that the rush-in voltage (ΔVa1) and the rush-in voltage (ΔVa2) are cancelled by each other, thereby allowing an effect of the rush-in voltage to be reduced.

Note that there is disclosed the control for setting the driving signal DS to the intermediate electric potential before the writing processing is executed (see JP 2011-107187A filed by the applicant).

<Wiring Configuration of Pixel Circuit>

A wiring configuration of the pixel circuit according to an embodiment of the present disclosure is configured so that the rush-in voltage (ΔVa1) and the rush-in voltage (ΔVa2) described above are cancelled by each other.

Figure 8:
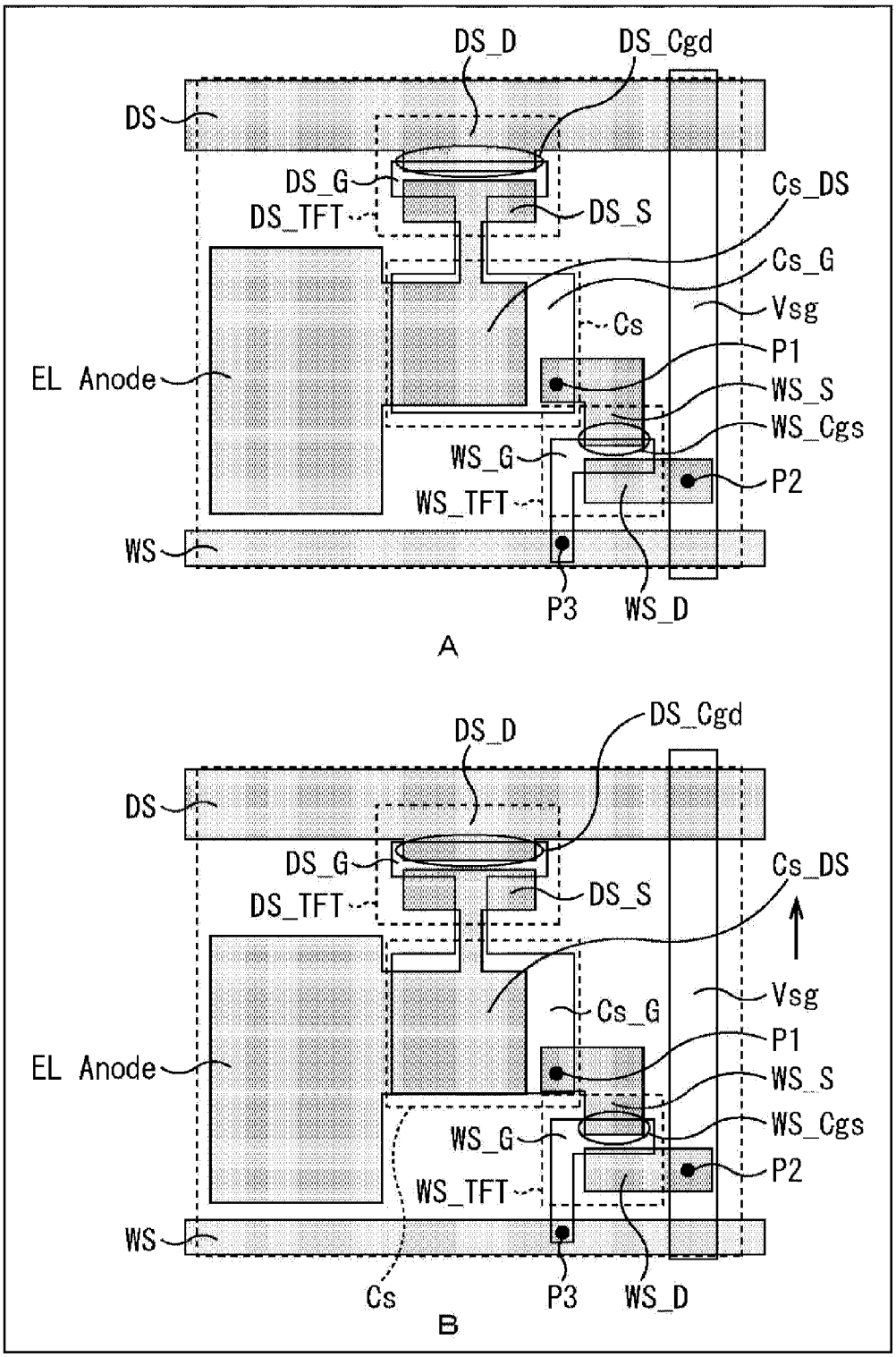
FIG. 8 is a diagram for explaining a configuration example of the pixel circuit of FIG. 1.
Figure 9:
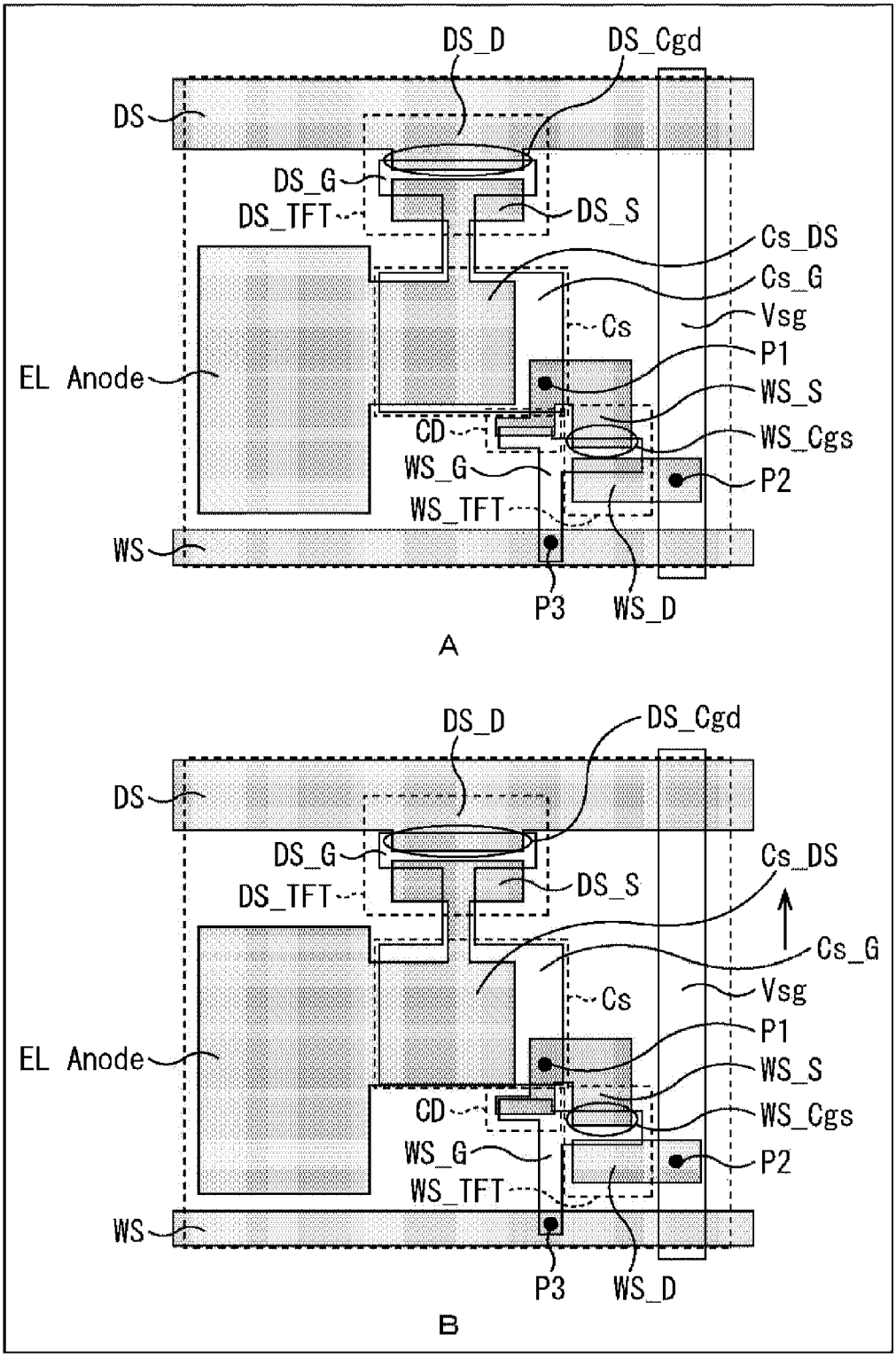
FIG. 9 is a diagram for explaining a configuration example in which dummy capacitance is added to the pixel circuit of FIG. 8.

Now, with reference to the circuit layout of FIG. 8, the wiring configuration of the pixel circuit will be discussed. Now that, in FIG. 8 and FIG. 9, a region surrounded by a solid line and colored in gray denotes the first metal layer forming the source and the drain of each of the writing transistor WS_TFT and the driving transistor DS_TFT, and a white region surrounded by a solid line denotes the second metal layer forming the gate. FIG. 8 and FIG. 9 are each a top diagram illustrating a state in which the first metal layer and the second metal layer are laminated. Therefore, in FIG. 8, layers other than these metal layers, such as a semiconductor layer, are not illustrated, and the first metal layer and the second metal layer are illustrated so as to exist backward and forward with respect to the sheet surface of FIG. 8.

The first metal layer is composed of, for example, aluminum, and the second metal layer is composed of, for example, molybdenum. Further, contacts P1 to P3 in the figure electrically connect the first metal layer with the second metal layer.

As shown in the circuit layout A of FIG. 8, the driving wiring DS is horizontally arranged in the uppermost portion, and the driving transistor DS_TFT is formed in the center lower portion of the driving wiring DS. In detail, a drain DS_D of the driving transistor DS_TFT is provided in the driving wiring DS, and a source DS_S is provided below the drain DS_D so as to be vertically opposed to the drain DS_D. Both of the drain DS_D and the source DS_S are provided in the first metal layer, but are not in electrical contact with each other and are vertically opposed to each other in the figure. A gate DS_G composed of the second metal layer is provided in the upper layer or lower layer of the first metal layer so as to straddle both ends of the drain DS_D and the source DS_S.

As shown in the circuit layout A of FIG. 8, in the lower portion of the source DS_S in the first metal layer, one electrode plate Cs_DS of the pixel capacitance Cs is provided so as to be connected to the source DS_S. Further, in the left portion of the electrode plate, an anode terminal EL_Anode of the organic EL element EL is provided.

Moreover, the other electrode plate Cs_G of the pixel capacitance Cs, composed of the second metal layer, is provided in the upper layer or lower layer of the electrode plate Cs_DS.

On the other hand, in the lowermost portion in the circuit layout A of FIG. 8, the writing wiring WS is horizontally provided, and the writing transistor WS_TFT is provided above the writing wiring WS. Moreover, in the right portion in the circuit layout A of FIG. 8, video signal wiring Vsg composed of the second metal layer is vertically provided.

The drain WS_D of the writing transistor WS_TFT provided in the first metal layer is electrically connected to the video signal wiring Vsg provided in the second metal layer by the contact P2. Further, the source WS_S of the writing transistor WS_TFT provided in the first metal layer is electrically connected to the electrode plate Cs_G of the pixel capacitance Cs provided in the second metal layer by the contact P1. And the drain WS_D and the source WS_S are provided in the first metal layer so as to be not in electric contact with each other and be vertically opposed to each other. Moreover, the gate WS_G of the writing transistor WS_TFT is provided in the second metal layer so as to straddle both ends of the drain WS_D and the source WS_S.

Meanwhile, the rush-in voltage (ΔVa1) in the falling of the writing signal WS and the rush-in voltage (ΔVa2) in the rising of the driving signal DS described above are expressed by the following Formula (1) and Formula (2), respectively.

$$\Delta Va1 = Vws \times (WS_Cgs)/\{(WS_Cgs)+Cs+(DS_Cgd)\} \quad (1)$$

$$\Delta Va2 = Vds \times (DS_Cgd)/\{(WS_Cgs)+Cs+(DS_Cgd)\} \quad (2)$$

Here, Vws is a falling electric potential difference of the writing signal WS, and Vds is a falling electric potential difference of the driving signal DS, and WS_Cgs, Cs and DS_Cgd are capacitance of parasitic capacitance WS_Cgs, Cs and DS_Cgd, respectively.

Therefore, if ΔVa1=ΔVa2, the effect of the rush-in voltage would be cancelled. Now, it is suggested to consider that a condition satisfying ΔVa1=ΔVa2 is derived from Formula (1) and Formula (2) described above. Since the parasitic capacitance WS_Cgs and DS_Cgd is sufficiently smaller than the pixel capacitance Cs, the circuit configured to satisfy the relationship of the following Formula (3) according to Formula (1) and Formula (2) may allow the effect of the rush-in voltage to be suppressed.

$$Vws \times (WS_Cgs) = Vds \times (DS_Cgd) \quad (3)$$

That is, it may be necessary to configure the electrodes of the wiring so as to satisfy the relationship of Formula (3) described above.

Meanwhile, as shown in the circuit layout A of FIG. 8, the drain WS_D and the source WS_S of the writing transistor WS_TFT and the drain DS_D and the source DS_S of the driving transistor DS_TFT in the first metal layer are arranged so as to be vertically opposed to each other in reverse directions to each other, and the gate WS_G in the second metal layer is provided so as to straddle the drain WS_D and the source WS_S, and the gate DS_G in the second metal layer is provided so as to straddle the drain DS_D and the source DS_S.

Moreover, this configuration allows the lower end of the source WS_S and the upper end of the gate WS_G in the writing transistor WS_TFT to be overlapped with each other to form the parasitic capacitance WS_Cgs. Similarly, it allows the lower end of the drain DS_D and the upper end of the gate DS_G in the driving transistor DS_TFT to be overlapped with each other to form the parasitic capacitance DS_Cgd.

With this configuration, for example, as shown in the circuit layout B of FIG. 8, when only the second metal layer is displaced upward as shown by the arrow in the figure, that is, the mask displacement occurs, the parasitic capacitance WS_Cgs and DS_Cgd is increased. Further, when it is displaced downward (not shown), the parasitic capacitance WS_Cgs and DS_Cgd is decreased.

That is, the drain and the source of each of the writing transistor WS_TFT and the driving transistor DS_TFT are arranged so as to be opposed to each other in the same direction, and also in reverse directions to each other between the two transistors, allowing the parasitic capacitance WS_Cgs and DS_Cgd generated by the mask displacement to be simultaneously increased and decreased. Moreover, in this case, as shown in the circuit layout B of FIG. 8, even when the horizontal mask displacement occurs, this configuration may allow the parasitic capacitance WS_Cgs and DS_Cgd generated by the mask displacement to be simultaneously increased and decreased. Moreover, if necessary, the area adjustment may be made to balance between the parasitic capacitance WS_Cgs and the parasitic capacitance DS_Cgd so as to satisfy the relationship of Formula (3) described above. This wiring configuration may enable effective arrangement for maintaining the relationship of Formula (3) described above, thus allowing the occurrence of the unevenness to be suppressed.

Note that, although the example that the drain DS_D, the source DS_S, the source WS_S and the drain WS_D are vertically arranged in this order from the top of the figure has been discussed in the foregoing description, it should be appreciated that any direction may be possible. Moreover, as long as the parasitic capacitance WS_Cgs and DS_Cgd is simultaneously increased and decreased, the drain DS_D, the source DS_S, the source WS_S and the drain WS_D may be arranged in another order, for example, in a reverse direction. Moreover, in the example of FIG. 8, although the writing transistor WS_TFT and the driving transistor DS_TFT should be arranged in one of an N channel and a P channel, even when the N channel and the P channel are mixed, or a circuit configuration and a driving system different from those in the foregoing description are used, the similar effect may be exhibited by such an arrangement that the rush-in voltages due to the parasitic capacitance of the writing transistor WS_TFT and the driving transistor DS_TFT and electric potential variations in the driving voltage are cancelled.

<Dummy Capacitance>

Moreover, when it is hard to suppress the effect due to the mask displacement because capacitance of one of the parasitic capacitance WS_Cgs and DS_Cgd is extremely large, the capacitance may be balanced by adding dummy capacitance to the smaller parasitic capacitance.

That is, for example, in the configuration of the circuit layout A of FIG. 8, when the parasitic capacitance WS_Cgs is extremely smaller than the parasitic capacitance DS_Cgd, as shown in the circuit layout A of FIG. 9, dummy capacitance CD may be provided so as to increase the area of each of the gate WS_G in the first metal layer and the source WS_S in the second metal layer.

In this manner, for example, as shown in the circuit layout B of FIG. 9, even when the mask pattern of the second metal layer is displaced upwards as shown by the arrow in the figure, it may be possible to increase the capacitance in a state in which the dummy capacitance CD is contained in the parasitic capacitance WS_Cgs. Further, when the mask pattern is displaced downwards (not shown), the capacitance may be decreased in the state in which the dummy capacitance CD is contained in the parasitic capacitance WS_Cgs.

Accordingly, it may become possible to change the capacitance WS_Cgs (containing the dummy capacitance CD), and the capacitance DS_Cgd so as to maintain the condition expressed by Formula (3) described above, thus allowing the occurrence of the unevenness to be suppressed.

Note that, although the example of adding the dummy capacitance CD to the parasitic capacitance WS_Cgs has been discussed in the foregoing description, it should be appreciated that the dummy capacitance CD may be added to the parasitic capacitance DS_Cgd.

<Example of Mounting Display Device According to Embodiment of Present Disclosure on Electronic Appliance>

Figure 10:
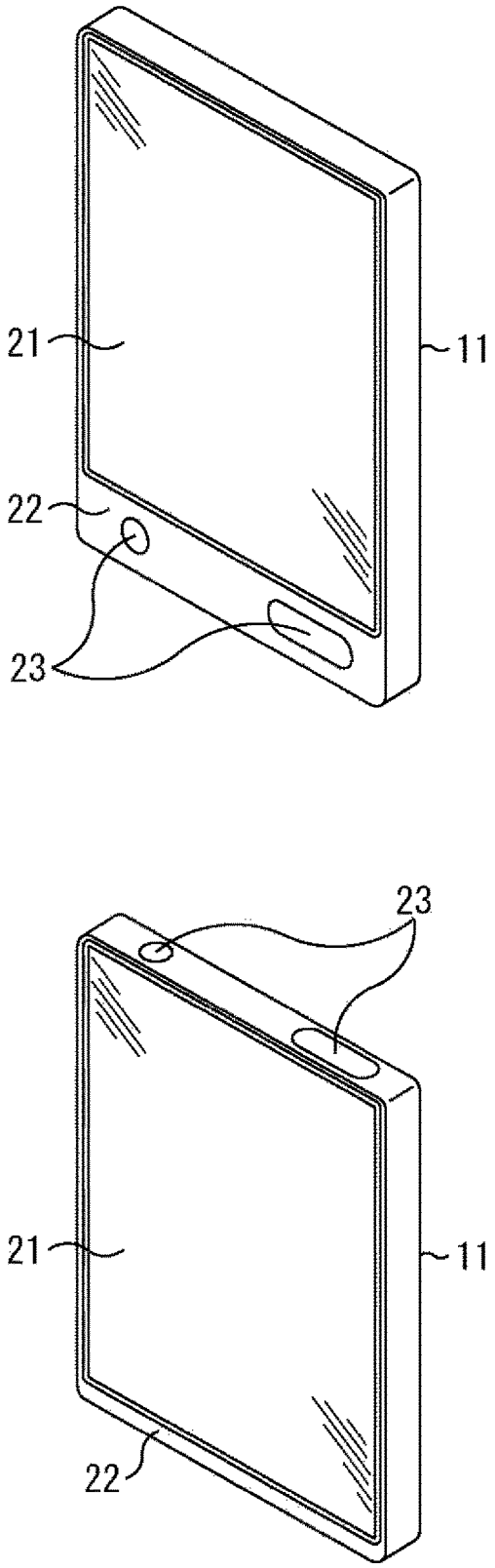
FIG. 10 is an appearance diagram of when the display device is mounted on an electronic appliance, according to an embodiment of the present disclosure.

The display device utilizing the organic EL element included in the pixel circuit of FIG. 1 described above may be mounted on an electronic appliance. FIG. 10 is an appearance diagram illustrating a smartphone as an example of the electronic appliance mounting the display device according to an embodiment of the present disclosure.

A smartphone 11 includes, for example, as shown in the upper portion or the lower portion of FIG. 10, a display part 21 configured by the display device according to an embodiment of the present disclosure, a housing 22, and an operation part 23. The operation part 23 may be provided in the front face of the housing 22, as shown in the upper portion of FIG. 10, or may be provided in the top face of the housing 22, as shown in the lower portion of FIG. 10.

As is obvious from the foregoing description of the embodiment, the display device according to an embodiment of the present disclosure, when being used as, for example, the display part 21 of the smartphone 11, may suppress the display unevenness caused by the rush-in voltage, thus contributing to improvement in picture quality of the display part 21.

As is described above, the wiring configuration in which the parasitic capacitance WS_Cgs and DS_Cgd that effects the rush-in voltages ($\Delta Va1$) and ($\Delta Va2$) varies so that, even when the mask displacement occurs, the rush-in voltage ($\Delta Va1$) in the falling of the writing signal WS and the rush-in voltage ($\Delta Va2$) in the rising of the driving signal DS are cancelled by each other, may allow the occurrence of the unevenness to be suppressed.

It should be understood that an embodiment of the present disclosure is not to be limited to the embodiment set forth hereinabove, and various modifications may be made without departing from the scope and spirit of the present disclosure.

Additionally, the present technology may also be configured as below.

(1) A display device including:

a light-emitting portion configured to constitute a pixel and emit light by a drive current;

a writing transistor configured to write a video signal into pixel capacitance;

a driving transistor configured to control the drive current of the light-emitting portion on the basis of the video signal written in the pixel capacitance;

a first metal layer configured to constitute a drain and a source of each of the driving transistor and the writing transistor; and a second metal layer configured to constitute a gate of each of the driving transistor and the writing transistor, wherein the drain and the source of each of the driving transistor and the writing transistor in the first metal layer are opposed to each other in a same predetermined direction, and the drain and the source of each of the driving transistor and the writing transistor are opposed to each other in reverse directions to each other in the same predetermined direction.

(2) The display device according to (1), wherein both of the driving transistor and the writing transistor are a P channel or an N channel.

(3) The display device according to (1) or (2), wherein the source of each of the driving transistor and the writing transistor is connected to the pixel capacitance.

(4) The display device according to any one of (1) to (3), wherein electric potential of the drain of the driving transistor is set to intermediate electric potential at timing immediately before the writing transistor writes the video signal into the pixel capacitance, wherein next, electric potential of the gate of the writing transistor is set to a high level, and is then set to a low level after the writing transistor writes the video signal into the pixel capacitance, and wherein then, the electric potential of the drain of the driving transistor is set to a high level.

(5) The display device according to (4), wherein parasitic capacitance between the gate and the drain of the driving transistor and parasitic capacitance between the gate and the source of the writing transistor in the first metal layer is adjusted so that a first rush-in voltage of when the electric potential of the gate of the writing transistor is set to the low level after the writing transistor writes the video signal into the pixel capacitance, and a second rush-in voltage of when the electric potential of the drain of the driving transistor is set to the high level after the writing transistor writes the video signal into the pixel capacitance are cancelled by each other.

(6) The display device according to (5), further including:

dummy capacitance configured to adjust a balance between the parasitic capacitance of the driving transistor and the parasitic capacitance of the writing transistor.

(7) An electronic appliance including:

a light-emitting portion configured to constitute a pixel and emit light by a drive current;

a writing transistor configured to write a video signal into pixel capacitance;

a driving transistor configured to control the drive current of the light-emitting portion on the basis of the video signal written in the pixel capacitance;

a first metal layer configured to constitute a drain and a source of each of the driving transistor and the writing transistor; and a second metal layer configured to constitute a gate of each of the driving transistor and the writing transistor, wherein the drain and the source of each of the driving transistor and the writing transistor in the first metal layer are opposed to each other in a same predetermined direction, and the drain and the source of each of the driving transistor and the writing transistor are opposed to each other in reverse directions to each other in the same predetermined direction.

What is claimed is:

1. A display device comprising:

a light-emitting portion configured to constitute a pixel and emit light in response to a drive current;

a writing transistor configured to write a video signal into a pixel capacitance;

a driving transistor configured to control the drive current of the light-emitting portion on the basis of the video signal written in the pixel capacitance;

a first metal layer configured to constitute a drain and a source of each of the driving transistor and the writing transistor; and a second metal layer configured to constitute a gate of each of the driving transistor and the writing transistor, wherein the drain and the source of each of the driving transistor and the writing transistor in the first metal layer are opposed to each other in both a linear predetermined direction, and in reverse directions to each other relative to the linear predetermined direction, and wherein the drain of the driving transistor, the source of the driving transistor, the source of the writing transistor, and the drain of the writing transistor are arranged in this order in the linear predetermined direction.

2. The display device according to claim 1, wherein both of the driving transistor and the writing transistor are a P channel or an N channel.

3. The display device according to claim 1, wherein the source of each of the driving transistor and the writing transistor is connected to the pixel capacitance.

4. The display device according to claim 1, wherein electric potential of the drain of the driving transistor is set to intermediate electric potential at timing immediately before the writing transistor writes the video signal into the pixel capacitance, wherein next, electric potential of the gate of the writing transistor is set to a high level, and is then set to a low level after the writing transistor writes the video signal into the pixel capacitance, and wherein then, the electric potential of the drain of the driving transistor is set to the high level.

5. The display device according to claim 4, wherein a parasitic capacitance between the gate and the drain of the driving transistor and a parasitic capacitance between the gate and the source of the writing transistor in the first metal layer are adjusted so that a first rush-in voltage of when the electric potential of the gate of the writing transistor is set to the low level after the writing transistor writes the video signal into the pixel capacitance, and a second rush-in voltage of when the electric potential of the drain of the driving transistor is set to the high level after the writing transistor writes the video signal into the pixel capacitance are cancelled by each other.

6. The display device according to claim 5, further comprising:

a dummy capacitance configured to adjust a balance between the parasitic capacitance of the driving transistor and the parasitic capacitance of the writing transistor.

7. The display device according to claim 6, wherein one electrode of the dummy capacitance is integral with the source of the writing transistor.

8. The display device according to claim 1, wherein the first metal layer further constitutes a writing wiring configured to supply a writing signal to the gate of the writing transistor.

9. The display device according to claim 8, further comprising a contact configured to electrically connect the writing wiring to the gate of the writing transistor.

10. The display device according to claim 1, wherein the first metal layer further constitutes a driving wiring configured to supply a drive signal to the drain of the driving transistor.

11. An electronic appliance comprising:

a light-emitting portion configured to constitute a pixel and emit light in response to a drive current;

a writing transistor configured to write a video signal into a pixel capacitance;

a driving transistor configured to control the drive current of the light-emitting portion on the basis of the video signal written in the pixel capacitance;

a first metal layer configured to constitute a drain and a source of each of the driving transistor and the writing transistor; and a second metal layer configured to constitute a gate of each of the driving transistor and the writing transistor, wherein the drain and the source of each of the driving transistor and the writing transistor in the first metal layer are opposed to each other in both a linear predetermined direction, and in reverse directions to each other relative to the linear predetermined direction, and wherein the drain of the driving transistor, the source of the driving transistor, the source of the writing transistor, and the drain of the writing transistor are arranged in this order in the linear predetermined direction.

12. The electronic appliance according to claim 11, wherein both of the driving transistor and the writing transistor are a P channel or an N channel.

13. The electronic appliance according to claim 11, wherein the source of each of the driving transistor and the writing transistor is connected to the pixel capacitance.

14. The electronic appliance according to claim 11, wherein electric potential of the drain of the driving transistor is set to intermediate electric potential at timing immediately before the writing transistor writes the video signal into the pixel capacitance, wherein next, electric potential of the gate of the writing transistor is set to a high level, and is then set to a low level after the writing transistor writes the video signal into the pixel capacitance, and wherein then, the electric potential of the drain of the driving transistor is set to the high level.

15. The electronic appliance according to claim 14, wherein a parasitic capacitance between the gate and the drain of the driving transistor and a parasitic capacitance between the gate and the source of the writing transistor in the first metal layer are adjusted so that a first rush-in voltage of when the electric potential of the gate of the writing transistor is set to the low level after the writing transistor writes the video signal into the pixel capacitance, and a second rush-in voltage of when the electric potential of the drain of the driving transistor is set to the high level after the writing transistor writes the video signal into the pixel capacitance are cancelled by each other.

16. The electronic appliance according to claim 15, further comprising:

a dummy capacitance configured to adjust a balance between the parasitic capacitance of the driving transistor and the parasitic capacitance of the writing transistor.

17. The electronic appliance according to claim 16, wherein one electrode of the dummy capacitance is integral with the source of the writing transistor.

18. The electronic appliance according to claim 11, wherein the first metal layer further constitutes a writing wiring configured to supply a writing signal to the gate of the writing transistor.

19. The electronic appliance according to claim 18, further comprising a contact configured to electrically connect the writing wiring to the gate of the writing transistor.

20. The electronic appliance according to claim 11, wherein the first metal layer further constitutes a driving wiring configured to supply a drive signal to the drain of the driving transistor.

* * * * *